US009102154B2

(12) United States Patent
Yokoyama et al.

(10) Patent No.: US 9,102,154 B2
(45) Date of Patent: Aug. 11, 2015

(54) INK JET HEAD AND INK JET PRINTING APPARATUS HAVING THE SAME

(71) Applicant: TOSHIBA TEC KABUSHIKI KAISHA, Tokyo (JP)

(72) Inventors: Shuhei Yokoyama, Shizuoka (JP); Ryutaro Kusunoki, Shizuoka (JP); Ryuichi Arai, Shizuoka (JP); Chiaki Tanuma, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/209,363

(22) Filed: Mar. 13, 2014

(65) Prior Publication Data

US 2014/0267498 A1 Sep. 18, 2014

(30) Foreign Application Priority Data

Mar. 13, 2013 (JP) ..... 2013-050789

(51) Int. Cl.
*B41J 2/135* (2006.01)
*B41J 2/14* (2006.01)
*B41J 2/16* (2006.01)

(52) U.S. Cl.
CPC ..... *B41J 2/162* (2013.01); *B41J 2/14233* (2013.01); *B41J 2/161* (2013.01); *B41J 2/1628* (2013.01); *B41J 2/1629* (2013.01); *B41J 2/1631* (2013.01); *B41J 2/1642* (2013.01); *B41J 2/1645* (2013.01); *B41J 2/1646* (2013.01); *B41J 2002/1425* (2013.01); *B41J 2002/14491* (2013.01); *B41J 2202/11* (2013.01)

(58) Field of Classification Search
USPC ..... 347/45
See application file for complete search history.

(56) References Cited

U.S. PATENT DOCUMENTS

| | | | | |
|---|---|---|---|---|
| 2003/0030697 | A1* | 2/2003 | Kwon et al. | 347/45 |
| 2007/0188551 | A1* | 8/2007 | Chen et al. | 347/45 |
| 2012/0056947 | A1 | 3/2012 | Tanuma et al. | |
| 2013/0063522 | A1 | 3/2013 | Arai et al. | |
| 2013/0070027 | A1 | 3/2013 | Arai et al. | |
| 2013/0070030 | A1 | 3/2013 | Kusunoki et al. | |

(Continued)

FOREIGN PATENT DOCUMENTS

| | | | |
|---|---|---|---|
| JP | H3-065350 | A | 3/1991 |
| JP | H6-316083 | A | 11/1994 |

(Continued)

OTHER PUBLICATIONS

Japanese Office Action with English translation, Patent Application 2013-050789, dated Mar. 24, 2015.

*Primary Examiner* — Stephen Meier
*Assistant Examiner* — Alexander D Shenderov
(74) *Attorney, Agent, or Firm* — Patterson & Sheridan, LLP

(57) ABSTRACT

An ink jet head includes a pressure chamber formed to hold ink, a vibrating plate, a driving element, and a protective film covering the driving element. The vibrating plate is provided at one end of the pressure chamber, and has a first opening through which the ink held in the pressure chamber is discharged. The driving element is provided on a surface of the vibrating plate and is configured to cause a volume of the pressure chamber to be changed by deforming the vibrating plate upon application of voltage to the driving element. The protective film has a second opening aligned with the first opening and through which the ink held in the pressure chamber is discharged.

15 Claims, 11 Drawing Sheets

(56) References Cited

U.S. PATENT DOCUMENTS

| | | | |
|---|---|---|---|
| 2013/0222481 | A1 | 8/2013 | Yokoyama et al. |
| 2013/0222484 | A1 | 8/2013 | Yokoyama et al. |
| 2013/0271530 | A1 | 10/2013 | Yokoyama et al. |
| 2014/0063095 | A1 | 3/2014 | Yokoyama et al. |
| 2014/0071204 | A1 | 3/2014 | Kusunoki et al. |

FOREIGN PATENT DOCUMENTS

| | | | | | |
|---|---|---|---|---|---|
| JP | 10058672 | A | * | 8/1996 | ..... B41J 2/15 |
| JP | 2004-268359 | A | | 9/2004 | |
| JP | 2006-056103 | A | | 3/2006 | |
| JP | 2011-056939 | A | | 3/2011 | |
| JP | 2012-071587 | A | | 4/2012 | |

* cited by examiner

INK JET HEAD AND INK JET PRINTING APPARATUS HAVING THE SAME

CROSS-REFERENCE TO RELATED APPLICATION

This application is based upon and claims the benefit of priority from Japanese Patent Application No. 2013-050789, filed Mar. 13, 2013, the entire contents of which are incorporated herein by reference.

FIELD

Embodiments described herein relate generally to an ink jet head and an ink jet printing apparatus.

BACKGROUND

An inkjet printing apparatus forms an image on a medium by discharging ink droplets from nozzles according to an image signal. One type of the ink jet printing apparatus is a piezoelectric element type.

An ink jet printing apparatus of the piezoelectric element type has an ink jet head that includes a nozzle plate. The nozzle plate includes a nozzle and an actuator having a piezoelectric film and metal electrode films formed on both surfaces of the piezoelectric film. Ink is discharged through the nozzle by applying a voltage to the actuator.

Quality of the image formed depends on an accuracy of ink discharging positions, and the accuracy depends on the shape of the nozzle. Thus, when the shape of the nozzle is not uniform, the accuracy of the ink discharging positions may decrease and, as a result, the quality of the image may become worse.

DETAILED DESCRIPTION

In general, according to one embodiment, there is provided an ink jet head including a pressure chamber formed to hold ink, a vibrating plate, a driving element, and a protective film covering the driving element. The vibrating plate is provided at one end of the pressure chamber, and has a first opening through which the ink held in the pressure chamber is discharged. The driving element is provided on a surface of the vibrating plate and is configured to cause a volume of the pressure chamber to be changed by deforming the vibrating plate upon application of voltage to the driving element. The protective film has a second opening aligned with the first opening and through which the ink held in the pressure chamber is discharged.

Hereinafter, a first embodiment will be described with reference to FIGS. 1 to 6. Each element hereinafter may be expressed by one or more expressions. However, this does not deny that an element expressed by one expression may not be expressed in different ways, and does not restrict other ways of expressions that are not shown by way of example.

Figure 1:
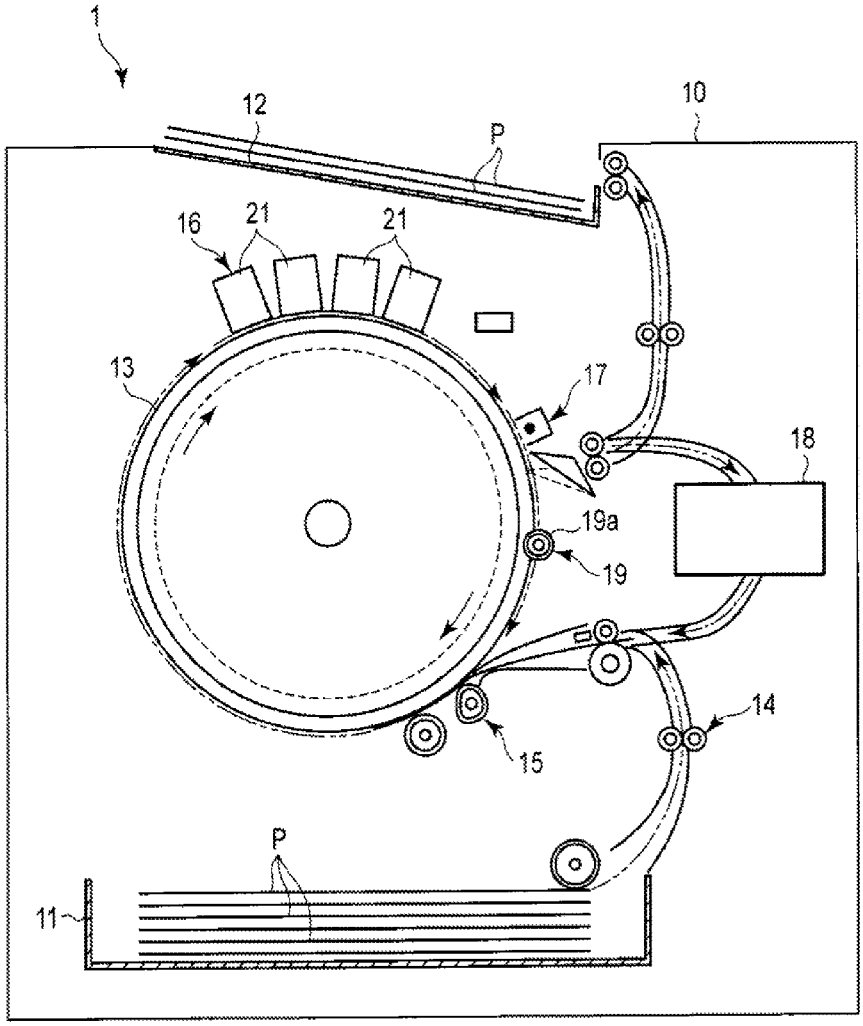
FIG. 1 is a cross-sectional view of an ink jet printer as an example of an ink jet printing apparatus according to a first embodiment.

FIG. 1 is a cross-sectional view of an ink jet printer 1 according to the first embodiment. The ink jet printer 1 is an example of an ink jet printing apparatus. The ink jet printing apparatus is not limited to the ink jet printer and may be other apparatuses such as a copying machine having a printing function.

The ink jet printer 1 shown in FIG. 1 performs various processes such as image formation while transporting recording paper P which is a recording medium. The ink jet printer 1 includes a housing 10, a paper feeding cassette 11, a paper discharging tray 12, a holding roller (drum) 13, a transporting device 14, a holding device 15, a image forming device 16, a static eliminating and separating device 17, a reversing device 18, and a cleaning device 19.

The paper feeding cassette 11 stores plural sheets of recording paper P and is disposed in the housing 10. The paper discharging tray 12 is disposed in the upper portion of the housing 10. The recording paper P on which an image is formed by the ink jet printer 1 is discharged to the paper discharging tray 12.

The transporting device 14 includes plural guides and plural transporting rollers arranged along a path through which the recording paper P is transported. Since the transporting roller is driven to rotate by a motor, the recording paper P is transported from the paper feeding cassette 11 to the paper discharging tray 12.

The holding roller 13 includes a cylindrical frame formed of a conductor, and a thin insulating layer formed on the surface of the frame. The frame is grounded (ground-connected). The holding roller 13 rotates to transport the recording paper P while holding the recording paper P on the surface thereof.

The holding device 15 causes the recording paper P transported by the transporting device 14 from the paper feeding cassette 11 to be held on the holding roller 13 by making the paper adhere to the surface (outer peripheral surface) of the holding roller 13. The holding device 15 presses the recording paper P against the holding roller 13, and then, makes the recording paper P adhere to the holding roller 13 due to electrostatic force.

The image forming device 16 forms an image on the recording paper P held on the outer surface of the holding roller 13 by the function of the holding device 15. The image forming device 16 includes plural ink jet heads 21 facing the surface of the holding roller 13. The plural ink jet heads 21 respectively discharge four colors of inks of cyan, magenta, yellow, and black onto the recording paper P to form an image.

The neutralizing and separating device 17 electrically neutralizes the recording paper P on which the image is formed to separate the paper P from the holding roller 13. The neutralizing and separating device 17 supplies an electrical charge to neutralize the recording paper P and a claw is set between the recording paper P and the holding roller 13. Accordingly, the recording paper P is separated from the holding roller 13. The recording paper P separated from the holding roller 13 is transported to the paper discharging tray 12 or the reversing device 18 by the transporting device 14.

The cleaning device 19 cleans the holding roller 13. The cleaning device 19 is disposed downstream with respect to the static eliminating and separating device 17 in a rotational direction of the holding roller 13. The cleaning device 19 brings a cleaning member 19*a* into contact with the surface of the rotating holding roller 13 to wash the surface of the rotating holding roller 13.

The reversing device 18 reverses the front and rear surfaces of the recording paper P separated from the holding roller 13 to supply the recording paper P to the surface of the holding roller 13 again. For example, the reversing device 18 reverses the side of the recording paper P by transporting the recording paper P along a predetermined reversing path through which the recording paper P is conveyed back.

Figure 2:
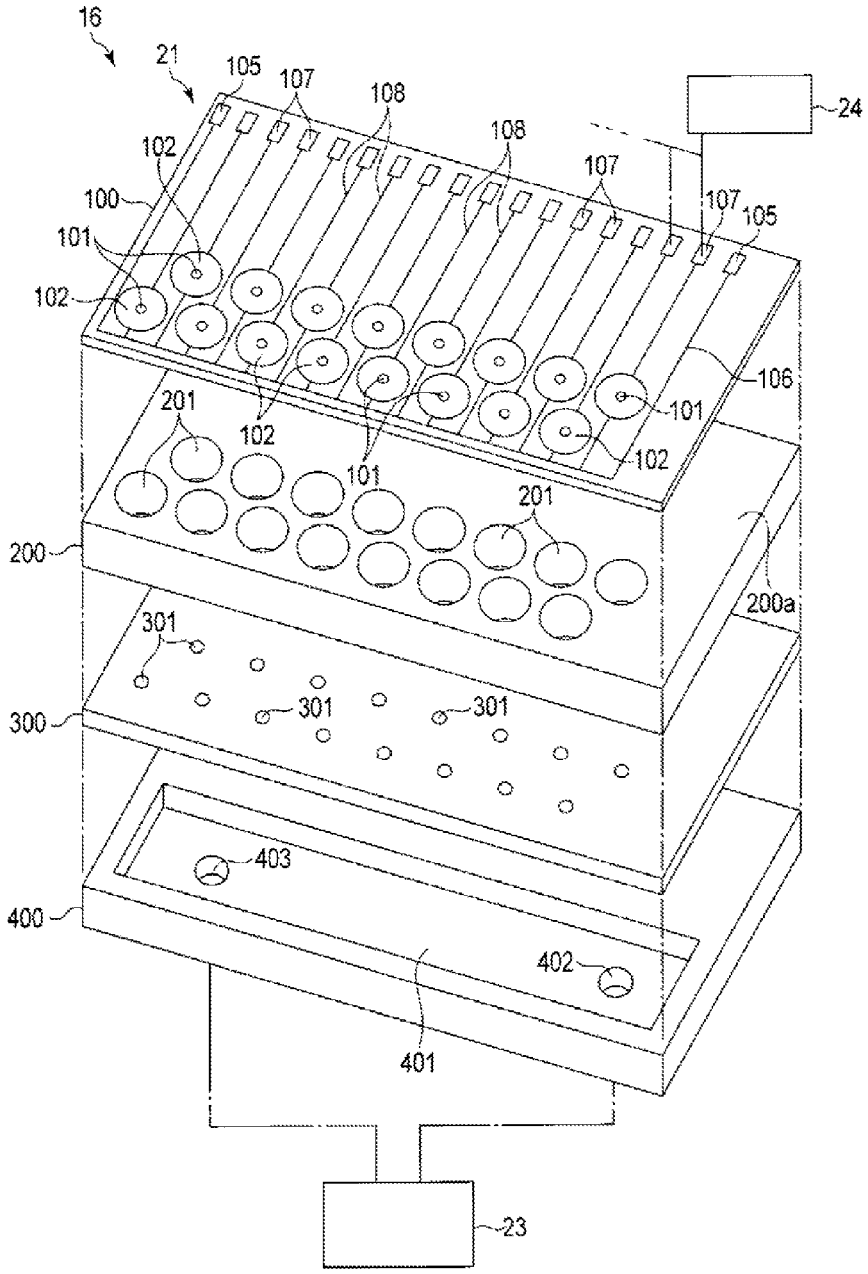
FIG. 2 is an exploded view of an ink jet head of the ink jet printing apparatus according to the first embodiment.
Figure 3:
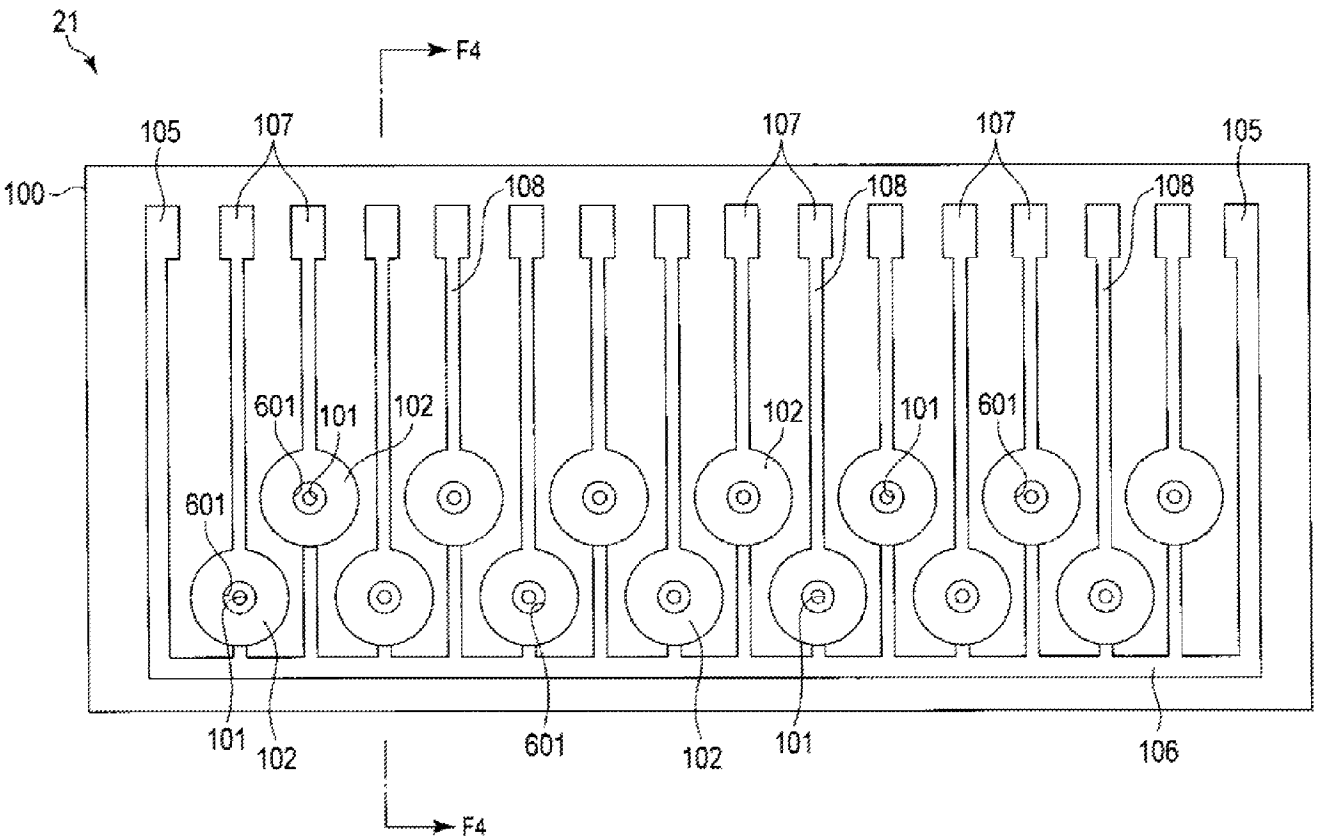
FIG. 3 is a plan view of the ink jet head according to the first embodiment.
Figure 4:
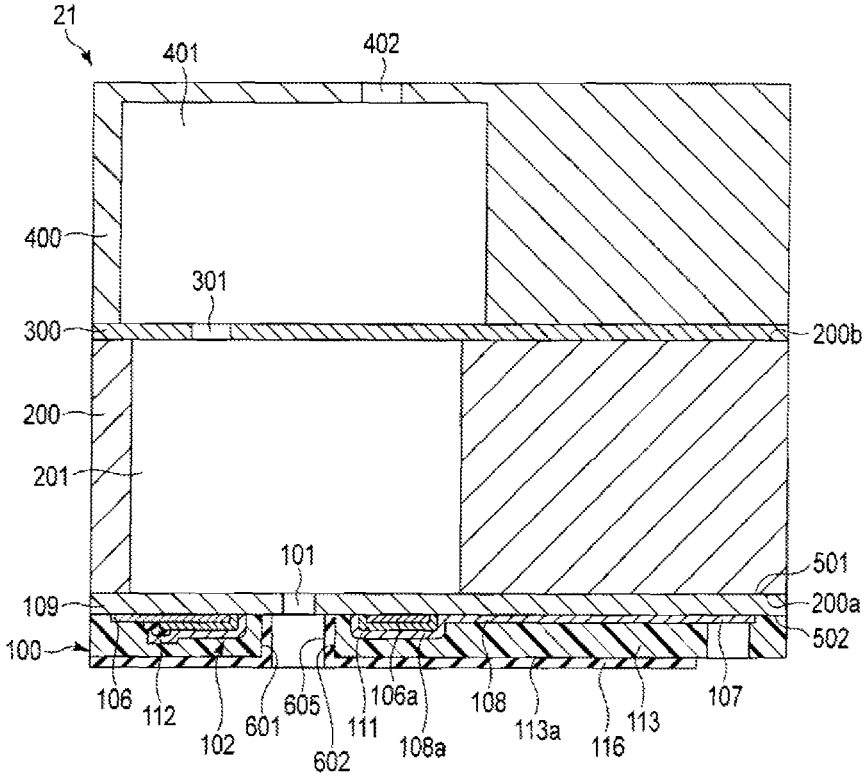
FIG. 4 is a cross-sectional view of the ink jet head according to the first embodiment taken along a line F4-F4 of FIG. 3.

FIG. 2 is an exploded view of the ink jet printer 1 according to the first embodiment. FIG. 3 is a plan view of the ink jet head 21. FIG. 4 is a cross-sectional view of the inkjet head 21 taken along the line F4-F4 of FIG. 3. In FIGS. 2 and 3, various elements which are originally hidden are indicated by solid lines for the sake of description.

As shown in FIG. 2, the ink jet printer 1 includes the ink jet head 21, an ink tank 23, and a controller 24. The ink jet printer 1 is an example of the inkjet printing apparatus. The ink jet printing apparatus is not limited thereto and may be other apparatuses such as a copying machine.

The ink jet head 21 includes a nozzle plate 100, a pressure chamber structure 200, a separate plate 300, and an ink channel structure 400. The pressure chamber structure 200 is an example of a substrate. The pressure chamber structure 200, the separate plate 300, and the ink channel structure 400 are fixed by, for example, an epoxy-based adhesive.

The nozzle plate 100 is formed in a rectangular shape. The nozzle plate 100 is formed on the pressure chamber structure 200 by a film formation process which will be described later. Therefore, the nozzle plate 100 is fixed to the pressure chamber structure 200.

Plural nozzles for discharging ink (orifices, ink discharging holes) 101 are provided on the nozzle plate 100. The plural nozzles 101 are formed in a circular shape, and penetrate one of plural layers forming the nozzle plate 100 in the thickness direction thereof. The diameter of the nozzle 101 is, for example 20 μm. The shape of the nozzle 101 is not limited to the circular shape.

For example, the pressure chamber structure 200 is formed of a silicon wafer and has a rectangular plate-like shape. Heating and formation of a thin film are repeated on the pressure chamber structure 200 in a process of manufacturing the ink jet head 21. The silicon wafer has heat resistance and is smoothened according to the semiconductor equipment and materials international (SEMI) standard. The pressure chamber structure 200 is not limited thereto, and, for example, other semiconductors such as a silicon carbide (SiC) germanium substrate may be used. The thickness of the pressure chamber structure 200 is, for example, 525 μm.

The pressure chamber structure 200 has a first end surface 200*a* that faces the nozzle plate 100, a second end surface 200*b*, and plural pressure chambers 201. The first end surface 200*a* is an example of one end of the substrate. The second end surface 200*b* is an example of the other end of the substrate. The first end surface 200*a* is flattened and the nozzle plate 100 is fixed to the first end surface 200*a*.

The pressure chamber 201 is formed in a circular shape but may have other shapes. The diameter of the pressure chamber 201 is, for example, 240 μm. The pressure chamber 201 extends from the first end surface 200*a* to the second end surface 200*b*. The pressure chamber 201 is opened to the first end surface 200*a* and is covered by the nozzle plate 100. The pressure chamber 201 is also opened to the second end surface 200*b*.

The plural pressure chambers 201 are disposed corresponding to the plural nozzles 101, and the pressure chamber and the corresponding nozzle 101 are disposed on the same axis. Therefore, each of the nozzles 101 communicates with the corresponding pressure chamber 201.

The separate plate 300 is formed of stainless steel and has a rectangular plate-like shape. The thickness of the separate plate 300 is, for example, 200 μm. The separate plate 300 is attached to the second end surface 200*b* of the pressure chamber structure 200. Therefore, the plural pressure chambers 201 are covered by the separate plate 300 on the surface opposite to the surface covered by the nozzle plate 100.

The separate plate 300 includes plural ink throttles 301 (ink supply holes connected to the pressure chamber 201). The plural ink throttles 301 are arranged corresponding to the pressure chambers 201. Therefore, the ink throttle 301 communicates with the pressure chamber 201. The diameter of the ink throttle 301 is, for example, 60 μm. The ink throttles 301 are formed to have approximately the same channel resistance of the ink flowing into the corresponding pressure chamber 201.

The ink channel structure 400 is formed of stainless steel and has a rectangular plate-like shape. The thickness of the ink channel structure 400 is, for example, 4 mm. The ink channel structure 400 has an ink supply path 401, an ink supply port 402, and an ink discharge port 403.

The ink supply path 401 is formed of, for example, a groove that has a depth of 2 mm from the surface of the ink channel structure 400. The ink supply path 401 surrounds all of the ink throttles 301. In other words, all of the ink throttles 301 are connected to the ink supply path 401.

The ink supply port 402 is connected to one end of the ink supply path 401. The ink supply port 402 is connected to the ink tank 23 in which ink used for image formation is stored and the ink is supplied to the ink supply path 401 through the ink supply port 402.

The ink coming to the ink supply path 401 from the ink supply port 402 is supplied to all of the pressure chambers 201 through the ink throttles 301. Further, the ink throttles 301 are formed to have approximately the same channel resistance of the ink flowing into the corresponding pressure chambers 201.

The ink discharge port 403 is connected to the other end of the ink supply path 401. The ink discharge port 403 is connected to the ink tank 23. The ink which is supplied from the ink supply port 402 and does not flow into the pressure chamber 201 is discharged to the ink tank 23 from the ink discharge port 403. In this manner, the ink is circulated through the ink supply path 401.

The temperature of the ink in the ink supply path 401 may be maintained constant by the circulation of the ink. Therefore, an increase in the temperature of the ink jet head 21 caused by heat generated due to the deformation of the nozzle plate 100 can be prevented.

As described above, the separate plate 300 and the ink channel structure 400 are formed of stainless steel. However, the materials of these elements 300 and 400 are not limited to the stainless steel. The elements 300 and 400 may be formed of other materials such as ceramics, resin, or metal (alloy) in consideration of differences between coefficients of expansion of the materials and the coefficient of expansion of the nozzle plate 100 to the extent that the materials do not affect the generation of pressure needed to discharge ink. The ceramics is, for example, alumina ceramics, zirconia, silicon carbide, nitrides and oxides such as silicon nitride and barium titanate. The resin is, for example, plastic materials such as acrylonitrile butadiene styrene (ABS), polyacetal, polyamide, polycarbonate, and polyether sulfone. The metal is, for example, aluminum or titanium.

The pressure chamber 201 retains the supplied ink. When a pressure change occurs in the ink held in each pressure chamber 201 due to deformation of the nozzle plate 100, the ink held in the pressure chambers 201 is discharged from each nozzle 101. The separate plate 300 prevents the ink from being released to the ink supply path 401 and thus works to maintain the pressure of the ink in the pressure chamber 201. The diameter of the ink throttle 301 is equal to or less than one-fourth of the diameter of the pressure chamber 201.

Next, the nozzle plate 100 will be described in detail. As shown in FIGS. 3 and 4, the nozzle plate 100 includes the above-described plural nozzles 101 and plural actuators 102, two common electrode terminal sections 105, a common electrode 106, plural wiring electrode terminal sections 107, plural wiring electrodes 108, a vibrating plate 109, a protective film 113, and an ink repellent film 116. The common electrode 106 is an example of a first electrode. The wiring electrode 108 is an example of a second electrode.

The vibrating plate 109 is formed in a rectangular plate-like shape on the first end surface 200*a* of the pressure chamber structure 200. The thickness of the vibrating plate 109 is, for example, 2 μm. The thickness of the vibrating plate 109 is within a range of about 1 μm to 50 μm.

The material of the vibrating plate 109 is, for example, $SiO_2$, which is an insulating material. The material of the vibrating plate 109 is not limited to $SiO_2$, and, for example, silicon nitride (SiN), aluminum oxide ($Al_2O_2$), hafnium oxide ($HfO_2$), and diamond like carbon (DLC) may be used. The material of the vibrating plate 109 is determined in consideration of, for example, heat resistance, insulating properties, thermal expansion coefficients, smoothness, and wettability to ink. When an ink having a high conductivity is used in the ink jet head 21, deterioration in ink during driving of the actuator 102 may be dependent on insulating properties of the material of the vibrating plate 109.

The vibrating plate 109 has a first surface 501 and a second surface 502. The first surface 501 is fixed to the first end surface 200*a* and covers the pressure chamber 201. The second surface 502 opposite to the first surface 501. The actuator 102, the common electrode 106, and the wiring electrode 108 are formed on the second surface 502 of the vibrating plate 109.

The plural actuators 102 are provided corresponding to the plural pressure chambers 201 and the plural nozzles 101. The actuator 102 causes pressure on the ink in the pressure chamber 201 to be increased such that the ink in the pressure chamber 201 is discharged from the nozzle 101.

As shown in FIG. 3, the actuator 102 is formed in an annular shape. The actuator 102 and the corresponding nozzle 101 are arranged on the same axis. Inside the actuator 102, the nozzle 101 is located.

The nozzles 101 are arranged in a staggered form (alternately) so that the nozzles 101 are arranged at a higher density. In other words, the plural nozzles 101 are linearly arranged in the longitudinal direction of the nozzle plate 100. In the short direction of the nozzle plate 100, two linear rows of the nozzles 101 are arranged. In the longitudinal direction of the nozzle plate 100, a distance between the centers of adjacent nozzles 101 is, for example, 340 μm. In the short direction of the nozzle plate 100, a distance between the two rows of the nozzles 101 is, for example, 240 μm.

As shown in FIG. 4, the actuator 102 respectively includes a piezoelectric film 111, an electrode section 106*a* of the common electrode 106, an electrode section 108*a* of the wiring electrode 108, and an insulating film 112. The piezoelectric film 111 is an example of a piezoelectric member.

The piezoelectric film 111 is formed of a lead zirconate titanate (PZT) and has a film shape. The piezoelectric film 111 is not limited thereto, and, for example, various materials such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$), ZnO, AlN, and the like may be used.

The piezoelectric film 111 is formed in an annular shape. The piezoelectric film 111, the nozzle 101, and the pressure chamber 201 are arranged on the same axis. The piezoelectric film 111 surrounds the nozzle 101. The external diameter of the piezoelectric film 111 is, for example, 176 μm. The internal diameter of the piezoelectric film 111 is, for example, 38 μm.

The thickness of the piezoelectric film 111 is, for example, 1 μm. The thickness of the piezoelectric film 111 is determined according to, for example, piezoelectric properties and a dielectric breakdown voltage. The thickness of the piezoelectric film 111 is within a range of about 0.1 μm to 5 μm.

The piezoelectric film 111 is disposed between the electrode section 108*a* of the wiring electrode 108 and the electrode section 106*a* of the common electrode 106. In other words, the electrode section 108*a* of the wiring electrode 108 and the electrode section 106*a* of the common electrode 106 overlap with the piezoelectric film 111.

The formed piezoelectric film 111 generates polarization in the thickness direction thereof. When an electric field is applied to the piezoelectric film 111 by the wiring electrode 108 and the common electrode 106 in a direction that is the same as the direction of the polarization, the actuator 102 expands or contracts in a direction orthogonal to the electric field direction. According to the expansion or contraction of the actuator 102, the vibrating plate 109 is deformed in the thickness direction of the nozzle plate 100. Thus, a pressure change occurs in the ink in the pressure chamber 201.

The expansion and contraction of the piezoelectric film 111 included in the actuator 102 will be further described. The piezoelectric film 111 expands and contracts in a direction orthogonal to the thickness (in-plane direction).

When the piezoelectric film 111 expands, the vibrating plate 109 on which the piezoelectric film 111 is disposed is bent in a direction in which the volume of the pressure chamber 201 increases. The bending of the vibrating plate 109 which makes the pressure chamber 201 expand generates negative pressure of the ink held in the pressure chamber 201. The ink is supplied from the ink channel structure 400 to the pressure chamber 201 due to the generated negative pressure.

When the piezoelectric film 111 contracts, the vibrating plate 109 on which the piezoelectric film 111 is disposed is bent in a direction in which the volume of the pressure chamber 201 decreases. The bending of the vibrating plate 109 towards the pressure chamber 201 generates positive pressure of the ink held in the pressure chamber 201. The ink droplets are discharged from the nozzle 101 provided on the vibrating plate 109 due to the generated positive pressure. When the volume of the pressure chamber 201 increases or decreases, the vicinity of the nozzle 101 provided on the vibrating plate 109 is deformed, such that the ink is discharged by the displacement of the piezoelectric film 111. In other words, the actuator 102 which causes ink to be discharged operates in a bending mode.

The electrode section 108*a* of the wiring electrode 108 is one of two electrodes connected to the piezoelectric film 111. The electrode section 108*a* of the wiring electrode 108 is formed in a larger annular shape than that of the piezoelectric film 111 and is formed on a discharge side (side toward the outside of the ink jet head 21) of the piezoelectric film 111. The external diameter of the electrode section 108*a* is, for example, 180 μm. The internal diameter of the electrode section 108*a* is, for example, 34 μm. Therefore, the inner peripheral section of the electrode section 108*a* is disposed at a position distant from the nozzle 101.

The electrode section 106*a* of the common electrode 106 is the other one of two electrodes connected to the piezoelectric film 111. The electrode section 106*a* of the common electrode 106 is formed in a smaller annular shape than that of the piezoelectric film 111 and is formed on the second surface 502 of the vibrating plate 109. The external diameter of the electrode section 106*a* is, for example, 172 μm. The internal diameter of the electrode section 106*a* is, for example, 42 μm.

The insulating film 112 is disposed between the common electrode 106 and the wiring electrode 108 outside a region in which the piezoelectric film 111 is formed. That is, the common electrode 106 and the wiring electrode 108 are separated by the piezoelectric film 111 and the insulating film 112. The insulating film 112 is formed of, for example, silicon oxide ($SiO_2$). The insulating film 112 may be formed of other materials. The thickness of the insulating film 112 is, for example, 0.2 μm.

As shown in FIG. 2, a controller 24 is connected to the ink jet head 21 through, for example, a flexible cable. The controller 24 is, for example, an IC which controls the ink jet head 21.

The wiring electrode terminal section 107 is provided at the end of the wiring electrode 108. The wiring electrode terminal section 107 is connected to the controller 24 through, for example, a flexible cable and transmits a signal to drive the actuator 102.

The common electrode terminal section 105 is provided, for example, on the second surface 502 of the vibrating plate 109. The common electrode terminal section 105 is an end of the common electrode 106 and is connected to, for example, a GND (ground=0V).

The wiring electrodes 108 are individually connected to the piezoelectric film 111 of the corresponding actuator 102 and transmit a signal to drive the actuator 102. The wiring electrodes 108 are used as individual electrodes to independently operate the piezoelectric films 111. Each of the plural wiring electrodes 108 includes the electrode section 108*a*, a wiring section, and the wiring electrode terminal section 107.

The wiring section of the wiring electrode 108 extends from the electrode section 108*a* to the wiring electrode terminal section 107. The electrode section 108*a* of the wiring electrode 108 and the nozzle 101 are arranged on the same axis. The inner peripheral region of the electrode section 108*a* is disposed slightly distant from the nozzle 101.

The plural wiring electrodes 108 are formed of a platinum (Pt) thin film. The wiring electrode 108 may be formed of other materials such as nickel (Ni), copper (Cu), aluminum (Al), silver (Ag), titanium (Ti), tungsten (W), molybdenum (Mo), and gold (Au). The thicknesses of the wiring electrode 108 are, for example, 0.5 μm. The thicknesses of the plural wiring electrodes 108 are within a range of 0.01 μm to 1 μm.

The common electrode 106 is connected to the plural piezoelectric films 111. The common electrode 106 includes the plural electrode sections 106*a*, plural wiring sections, and the two common electrode terminal sections 105.

The wiring section of the common electrode 106 extends from the electrode section 106*a* to the opposite side of the wiring section of the wiring electrode 108. The wiring sections of the common electrode 106 are arranged on one end of the nozzle plate 100 in the short direction and extend along both ends of the nozzle plate 100 in the longitudinal direction as shown in FIG. 3. The electrode section 106*a* and the nozzle 101 are provided on the same axis. The common electrode terminal sections 105 are respectively arranged at the both ends of the nozzle plate 100 in the longitudinal direction.

The common electrode 106 is formed of a platinum (Pt) and titanium (Ti) thin film. The common electrode 106 may be formed of other materials such as Ni, Cu, Al, Ti, W, Mo, and Au. The thickness of the common electrode 106 is, for example, 0.5 μm. The thickness of the common electrode 106 is approximately from 0.01 μm to 1 μm.

The width of each of the wiring sections of the common electrode 106 and the wiring electrode 108 are, for example 80 μm. Some of the wiring sections of the wiring electrodes 108 pass among the arranged actuators 102.

As shown in FIG. 4, the protective film 113 is provided on the second surface 502 of the vibrating plate 109. The protective film 113 is formed of, for example, non-photosensitive polyimide or positive photosensitive polyimide. The protective film 113 is not limited thereto and may be formed of other insulating materials such as resin, ceramics, and metal (alloy). As the resin, for example, plastic materials such as other types of polyimides, acrylonitrile butadiene styrene (ABS), polyacetal, polyamide, polycarbonate, and polyether sulfone may be used. As the ceramics, for example, zirconia, silicon carbide, and nitrides and oxides such as silicon nitride and barium titanate may be used. As the metal, for example, aluminum, SUS, and titanium may be used. As the material of the protective film 113, for example, materials having insulating properties may be used.

The material of the protective film 113 is greatly different from the material of the vibrating plate 109 in Young's modulus. The deformation amount of a plate is affected by the Young's modulus of the material and the thickness of the plate member. When the same force is applied to the plate member, the smaller the Young's modulus is and the smaller the thickness is, the larger the deformation amount of the plate member is. The Young's modulus of the vibrating plate 109 formed of $SiO_2$ is 80.6 GPa, and the Young's modulus of the protective film 113 formed of polyimide is 4 GPa. That is, a difference between the Young's modulus of the vibrating plate 109 and the Young's modulus of the protective film 113 is 76.6 GPa.

The thickness of the protective film 113 is, for example, 3 μm. The thickness of the protective film 113 is within a range of about 1 μm to 50 μm. The protective film 113 covers the second surface 502 of the vibrating plate 109, the common electrode 106, the wiring electrode 108, and the piezoelectric film 111.

The ink repellent film 116 covers a surface 113*a* of the protective film 113. The ink repellent film 116 is formed of, for example, a silicone-based liquid repellent material having liquid repellent properties. The ink repellent film 116 may be formed of other materials such as fluorine-containing organic materials. The thickness of the ink repellent film 116 is, for example, 1 μm. The ink repellent film 116 does not cover a portion of the protective film 113 so that the common electrode terminal section 105 and the wiring electrode terminal section 107 are exposed.

As shown in FIG. 4, an opening 601 are provided in the protective film 113. The plurality of the openings 601 are arranged corresponding to the plural nozzles 101 and connected to the surface 113*a* of the protective film 113. Each of the openings 601 is a circular hole, and each of the openings 601 and the corresponding nozzle 101 are arranged on the same axis. The shape of the openings 601 is not limited to the circular shape.

The diameter of the opening 601 is, for example, 30 μm. The diameter of the opening 601 is larger than the diameter of the nozzle 101, and is smaller than the internal diameter of the actuator 102 (internal diameter of electrode section 108*a* of the wiring electrode 108). A first inner peripheral surface 602 of the opening 601 extends orthogonal to the vibrating plate 109. In other words, the diameter of the opening 601 is constant in a direction orthogonal to the second surface 502 of the vibrating plate 109 (ink discharge direction).

The nozzle 101 and the second surface 502 of the vibrating plate 109 which surrounds the nozzle 101 are partially exposed in the opening 601. The first inner peripheral surface 602 of the opening 601 is distant from the nozzle 101. A part of the second surface 502 which surrounds the nozzle 101 is defined by the first inner peripheral surface 602 and the edge of the nozzle 101.

The first inner peripheral surface 602 of the opening 601 is covered by the ink repellent film 116. The thickness of the ink repellent film 116 which covers the first inner peripheral surface 602 is substantially uniform. The ink repellent film 116 which covers the first inner peripheral surface 602 forms a second inner peripheral surface 605. In other words, a hole having a smaller diameter than the diameter of the opening 601 is formed of the ink repellent film 116 inside the opening 601.

The diameter of the second inner peripheral surface 605 is, for example, 26 μm. The diameter of the second inner peripheral surface 605 is larger than the diameter of the nozzle 101. Therefore, the second inner peripheral surface 605 is distant from the nozzle 101.

The above-described ink jet head 21 performs, for example, printing (image formation) as follows. Ink is supplied from the ink tank 23 shown in FIG. 2 to the ink supply port 402 of the ink channel structure 400. The ink is supplied to the pressure chamber 201 through the ink throttle 301. The ink supplied to the pressure chamber 201 is supplied to the inside of the corresponding nozzle 101 and forms a meniscus in the nozzle 101. Pressure of the ink in pressure chamber 201 is maintained to be an appropriate negative pressure, and therefore the ink in the nozzle 101 is held therein without being discharged from the nozzle 101.

A print command signal is input to the controller 24 in response to an operation of a user. The controller 24 which received the print command outputs a signal to the actuators 102 through the wiring electrode 108. In other word, the controller 24 applies a driving voltage to the electrode sections 108*a* of the wiring electrode 108. Thus, an electric field is generated in the piezoelectric film 111 in a direction that is the same as the polarization direction, and the actuator 102 expands or contracts in a direction orthogonal to the electrical field direction.

The actuator 102 is interposed between the vibrating plate 109 and the protective film 113. Therefore, when the actuator 102 expands in a direction orthogonal to the electrical field direction, a force for deforming the vibrating plate in a concave shape (towards the pressure chamber 201) is applied to the vibrating plate 109. To the contrary, a force for deforming the protective film in a convex shape (apart from the pressure chamber 201) is applied to the protective film 113. When the actuator 102 contracts in a direction orthogonal to the electrical field direction, a force for deforming the vibrating plate in a convex shape (apart from the pressure chamber 201) is applied to the vibrating plate 109. Further, a force for deforming the protective film in a concave shape (towards the pressure chamber 201) is applied to the protective film 113.

The Young's modulus of the protective film 113 formed of polyimide is smaller than the Young's modulus of the vibrating plate 109 formed of $SiO_2$. Therefore, a deformation amount of the protective film 113 is larger than a deformation amount of the vibrating plate when the same force is applied thereto. When the actuator 102 expands in the direction orthogonal to the electrical field direction, the nozzle plate 100 is deformed in a convex shape (towards the pressure chamber 201). Owing to this, the volume of the pressure chamber 201 decreases (since the protective film 113 has a larger amount of deformation in a convex shape towards the pressure chamber 201). Contrarily, when the actuator 102 contracts in the direction orthogonal to the electric field direction, the nozzle plate 100 is deformed in a concave shape (apart from the pressure chamber 201). Owing to this, the volume of the pressure chamber 201 increases (since the protective film 113 has a larger amount of deformation in a concave shape apart from the pressure chamber 201).

When the volume of the pressure chamber 201 increases or decreases in accordance with the deformation of the vibrating plate 109, a pressure change occurs in the ink held in the pressure chamber 201. The ink supplied to the nozzle 101 is discharged due to the pressure change.

The larger the difference between the Young's modulus of the vibrating plate 109 and the Young's modulus of the protective film 113 is, the larger the difference between the deformation amount of the vibrating plate 109 and the deformation amount of the protective film 113 is, when the same amount of voltage is applied to the actuator 102. Therefore, as the difference between the Young's modulus of the vibrating plate 109 and the Young's modulus of the protective film 113 becomes larger, ink may be discharged at a lower voltage.

When the thickness and the Young's modulus of the vibrating plate 109 and the protective film 113 are the same, even when a voltage is applied to the actuator 102, forces for deforming the vibrating plate and the protective film in exactly opposite directions by the same deformation amount are applied to the vibrating plate 109 and the protective film 113. Therefore, the vibrating plate 109 is not deformed.

As described above, the deformation amount of the plate material is affected by not only the Young's modulus of the material but also the thickness of the plate material. When a deformation amount of the vibrating plate 109 and a deformation amount of the protective film 113 are set differently, it may be necessary to consider not only Young's modulus of the plate materials but also thickness of the plate materials. Even when the Young's modulus of the material of the vibrating plate 109 and the Young's modulus of the material of the protective film 113 are the same, when the thicknesses are different, ink discharge is possible.

Next, an example of a method for manufacturing the ink jet head 21 will be described. First, an $SiO_2$ film as the vibrating plate 109 is formed over the entire region of the first end surface 200*a* of the pressure chamber structure 200 (silicon wafer) before the pressure chamber 201 is formed. The $SiO_2$ film is formed by, for example, a CVD method.

In the process of manufacturing the inkjet head 21, the silicon wafer which forms the pressure chamber structure 200 is one large disc. The silicon wafer disc is cut into the plural pressure chamber structures 200 later. The embodiment is not limited thereto and one rectangular silicon wafer may be used to form one pressure chamber structure 200.

Next, a metal film that forms the common electrode 106 is formed on the second surface 502 of the vibrating plate 109. First, using a sputtering method, a Ti film and a Pt film are sequentially formed. The thickness of the Ti film is, for example, 0.45 μm, and the thickness of the Pt film is, for example, 0.05 μm. The metal film may be formed by other forming method such as deposition and plating.

After the metal film is formed, the metal film is formed into common electrode 106 by patterning. The patterning is performed by forming an etching mask on the metal film and removing a region of the metal film that is not covered by the etching mask through etching.

Since the nozzle 101 is formed in the center of the electrode section 106*a* of the common electrode 106, a region without the electrode film, which is concentric with the center of the electrode section 106*a*, is formed. Since the common electrode 106 is patterned, the vibrating plate 109 is exposed in regions in which the electrode section 106*a*, the wiring section, and the common electrode terminal section 105 in the common electrode 106 are not formed.

Next, the piezoelectric film 111 is formed on the common electrode 106. The piezoelectric film 111 is formed by, for example, an RF magnetron sputtering method. At this time, the temperature of the silicon wafer is, for example, 350° C. After the piezoelectric film formation, in order to give piezoelectric properties to the piezoelectric film 111, the piezoelectric film 111 is subjected to a heat treatment for three hours at 500° C. Thus, the piezoelectric film 111 can obtain a preferable piezoelectric performance. The piezoelectric film 111 may be formed by other forming methods such as a chemical vapor deposition (CVD) method, a sol-gel method, an aerosol deposition method (AD method), and a hydrothermal synthesis method. The piezoelectric film 111 is patterned by etching.

Since the nozzle 101 is formed in the center of the piezoelectric film 111, a region without a piezoelectric film, which is concentric with the piezoelectric film 111, is formed. The vibrating plate 109 is exposed in the region in which the piezoelectric film 111 is not formed. The piezoelectric film 111 covers the electrode section 106*a* of the common electrode 106.

Next, the insulating film 112 is formed on a part of the piezoelectric film 111 and a part of the common electrode 106. The insulating film 112 is formed by a CVD method which may achieve preferable insulating properties with low-temperature film formation. The insulating film 112 is formed and then, patterned. The insulating film 112 covers only a part of the piezoelectric film 111 to prevent a defect caused by fluctuation in a patterning process. The insulating film 112 covers the piezoelectric film 111 so as not to reduce a deformation amount of the piezoelectric film 111.

Next, a metal film for the wiring electrode 108 is formed on the vibrating plate 109, the piezoelectric film 111, and the insulating film 112. The metal film is formed by, for example, a sputtering method. The metal film may be formed by other forming methods such as vacuum deposition and plating.

The wiring electrode 108 is formed by patterning the metal film. The patterning is performed by forming an etching mask on an electrode film and removing a region of the electrode film not covered by the etching mask through etching.

Since the nozzle 101 is formed in the center of the electrode section 108*a* of the wiring electrode 108, a region without an electrode film, which is concentric with the center of the electrode section 108*a* of the wiring electrode 108, is formed. The electrode section 108*a* of the wiring electrode 108 covers the piezoelectric film 111.

Next, the $SiO_2$ film for the vibrating plate 109 is patterned to form the nozzle 101. The patterning is performed by forming an etching mask on the $SiO_2$ film and removing a region of the $SiO_2$ film not covered by the etching mask through etching.

The etching mask is formed by applying a photo resist onto the vibrating plate 109, performing pre-baking, exposing the vibrating plate using a mask on which a desired pattern is formed, and performing development, and post-baking.

Figure 5:
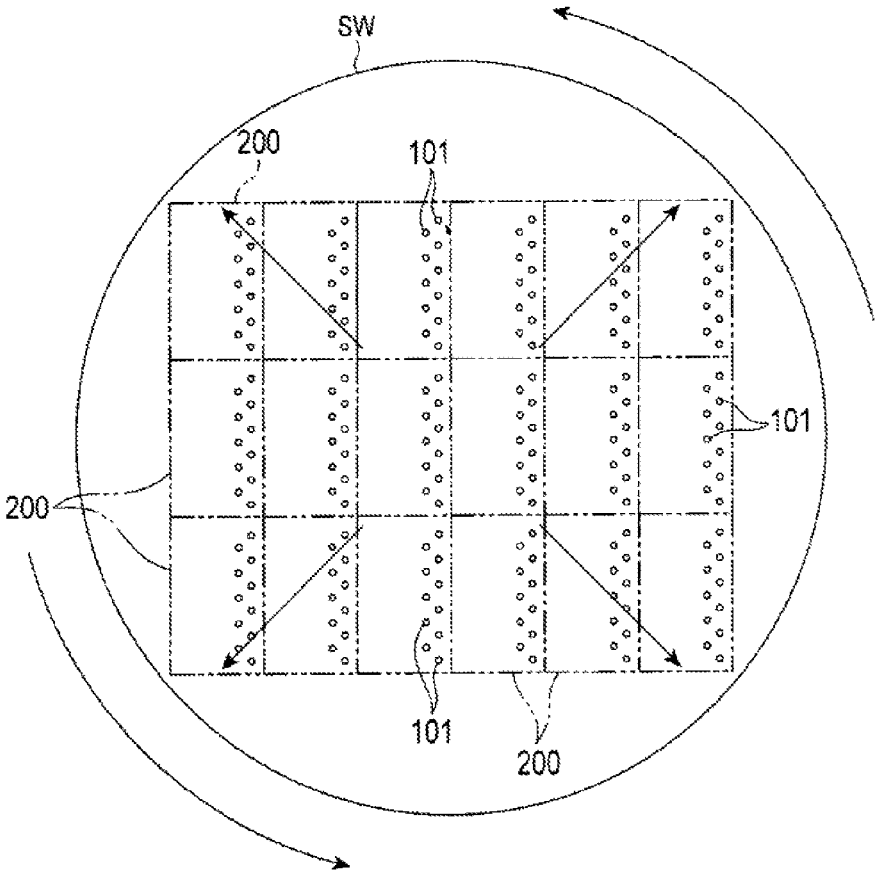
FIG. 5 is a plan view of a silicon wafer on which a protective film is formed according to the first embodiment.

FIG. 5 is a diagram schematically showing a process of forming the protective film. The protective film 113 is formed on the circular disc of the silicon wafer SW in which the plural pressure chamber structures 200 are formed as shown in FIG. 5 by a spin coating method.

First, the vibrating plate 109, the wiring electrode 108, the common electrode 106, and the insulating film 112 are covered by a solution containing a polyimide precursor. Next, while the silicon wafer SW rotates, the surface of the solution is smoothened. The protective film 113 is formed by performing thermal polymerization and solution removal by baking. The protective film 113 may be formed by other methods such as CVD, vacuum deposition, and plating.

Figure 6:
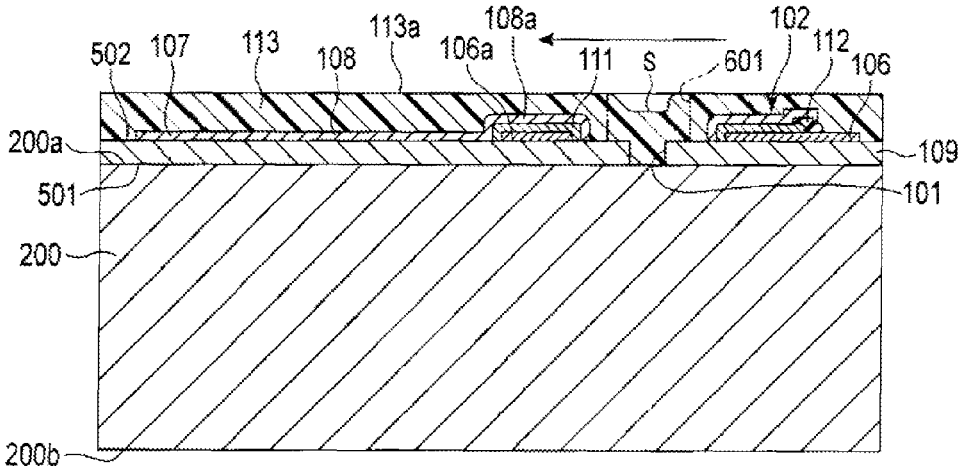
FIG. 6 is a cross-sectional view of an example of a pressure chamber structure on which the protective film is formed according to the first embodiment.

FIG. 6 is a cross-sectional view of an example of the pressure chamber structure 200 in which the protective film 113 is formed. As shown in FIG. 6, above the nozzle 101, an oval hollow S may be formed on the surface of the protective film 113. The hollow S may be formed due to, for example, centrifugal force applied to the solution by the spin coating method. Therefore, the hollow S has an non-uniform oval shape extending in the radial direction of the silicon wafer.

Next, the opening 601 is formed, and the common electrode terminal section 105 and the wiring electrode terminal section 107 are exposed by performing patterning. The patterning is performed in a procedure according to the material of the protective film 113.

When the protective film 113 is formed of non-photosensitive polyimide, first, a layer of a solution containing a polyimide precursor is formed by a spin coating method, and then, the protective film is formed by performing thermal polymerization and solvent removal by baking. Then, patterning is performed by forming an etching mask on the non-photosensitive polyimide film and removing the polyimide film not covered by the etching mask through etching. The etching mask is formed by applying a photo resist onto the non-photosensitive polyimide film, performing pre-baking, exposing the film using a mask on which a desired pattern is formed, and performing development and post-baking.

When the protective film 113 is formed of positive photosensitive polyimide, first, a layer of a solution is formed by a spin coating method, and then, pre-baking is performed. Then, exposure is performed using a mask on which a circular pattern section (opening 601), which is concentric with the center of the actuator 102, has a diameter of 30 and had an opening corresponding to regions of the wiring electrode terminal section 107 and the common electrode terminal section 105 (through which light passes), and patterning is performed through a development process. Then, post-baking is performed to form the protective film 113.

The opening 601 indicated by a two-dot chain line in FIG. 6 is formed on the protective film 113 by the patterning. The hollow S is removed by the patterning, and the opening 601 is formed. A part of the hollow S may remain after the patterning.

Next, a cover tape is attached onto the protective film 113. The cover tape is, for example, a tape to protect a back surface of the silicon wafer from chemical mechanical polishing (CMP). The plural pressure chambers 201 is formed in the pressure chamber structure 200 by vertically reversing pressure chamber structure 200 to which the cover tape is attached. The pressure chamber 201 is formed by patterning.

An etching mask is formed on the second end surface 200*b* of the pressure chamber structure 200, which is a silicon wafer, and regions of the silicon wafer not covered by the etching mask are removed by using a so-called vertical deep drilling dry etching exclusive for a silicon substrate. Thus, the pressure chamber 201 is formed.

An SF6 gas used for the etching does not have an etching effect on the $SiO_2$ film used for the vibrating plate 109 and the polyimide film used for the protective film 113. Therefore, the progress of the dry etching of the silicon wafer, in which the pressure chamber 201 is formed, is stopped at the vibrating plate 109.

In the above-described etching, various methods such as a wet etching method in which a chemical is used and a dry etching method in which plasma is used may be used. Further, the etching method and etching condition may be changed according to materials of the insulating film, the electrode film, the piezoelectric film, and the like. After the etching by each of the photo resist films ends, the remaining photo resist films are removed by a solution.

Next, the separate plate 300 and the ink channel structure 400 are attached to the pressure chamber structure 200. That is, the separate plate 300 to which the ink channel structure 400 is attached is attached to the pressure chamber structure 200 by an epoxy-based adhesive.

Next, the cover tape is attached to a part of the protective film 113 so as to cover the common electrode terminal section 105 and the wiring electrode terminal section 107. The cover tape is made of resin and may be easily attached to or detached from the protective film 113. The cover tape prevents adhesion of dust and the ink repellent film 116, which will be described later, to the common electrode terminal section 105 and the wiring electrode terminal section 107.

Next, the ink repellent film 116 is formed on the protective film 113. The ink repellent film 116 is formed by spin-coating an ink repellent film material in a liquid state on the protective film 113. At this time, positive pressure air is injected from the ink supply port 402. Consequently, the positive pressure air is discharged from the nozzle 101 connected to the ink supply path 401. When the ink repellent film material in a liquid state is applied in this state, the ink repellent film material is prevented from adhering to the inner peripheral surface of the nozzle 101. The ink repellent film 116 is formed and then, the cover tape is peeled off from the protective film 113.

Next, the second inner peripheral surface 605 having a diameter of 26 μm is formed on the ink repellent film 116 that covers the opening 601 by patterning the ink repellent film 116 formed in the opening 601. The patterning is performed by forming an etching mask on the ink repellent film 116 and removing the ink repellent film 116 not covered by the etching mask through etching. The etching mask is formed by applying a photo resist onto the ink repellent film 116, performing pre-baking, exposing the vibrating plate using a mask on which a desired pattern is formed, and performing development and post-baking. Accordingly, the nozzle 101 is completely exposed and a part of the second surface 502 of the vibrating plate 109 that surrounds the nozzle 101 is also exposed. A part of the second surface 502 that surrounds the nozzle 101 may be covered by the ink repellent film 116.

Next, the silicon wafer SW is cut into plural ink jet heads 21. The ink jet heads 21 are mounted in the ink jet printer 1. The controller 24 is connected to the wiring electrode terminal section 107 through, for example, a flexible cable. Further, the ink supply port 402 and the ink discharge port 403 of the ink channel structure 400 are connected to the ink tank 23.

In the ink jet head 21 according to the first embodiment, the nozzle 101 is provided on the vibrating plate 109 and the opening 601 formed on the protective film 113 communicates with the nozzle 101 and forms the first inner peripheral surface that is arranged distant from the nozzle 101. In other words, the nozzle 101 from which the ink is discharged is formed in the vibrating plate 109, which is one of the layers forming the nozzle plate 100, and not formed on the protective film 113, which is another layer. For this reason, the shape and position of the nozzle 101 are determined by one process of forming the nozzle 101 on the vibrating plate 109, and thus, uniformity in the shape of the nozzle 101 is improved. Therefore, it is possible to prevent deterioration in discharge position accuracy of ink at a low cost.

Further, for example, since the protective film 113 is formed by the spin coating method, there is a concern that the hollow S may be generated. However, the hollow S is removed by performing patterning to form the opening 601. Even when a part of the hollow S remains, as the opening 601 is formed ink discharge from the nozzle 101 is not affected. Therefore, it is possible to prevent deterioration in discharge position accuracy of the ink.

The opening 601 is a circular hole, and the diameter of the opening 601 is larger than the diameter of the nozzle 101. Therefore, the opening 601 does not negatively affect the ink discharge from the nozzle 101, and deterioration in discharge position accuracy of ink is prevented.

The ink repellent film 116 covers the first inner peripheral surface 602 of the opening 601, and the second inner peripheral surface 605 on which the ink repellent film 116 is formed is arranged distant from the nozzle 101. Accordingly, the ink may be prevented from leaking out from the nozzle 101, and ink discharge from the nozzle 101 may not be affected by ink wetting. Thus, deterioration in discharge position accuracy of ink may be prevented.

A detailed description will be given below. When the first inner peripheral surface 602 of the opening 601 is not covered by the ink repellent film 116, the ink steeping from the nozzle 101 flows to the opening 601 because of wetting of the vibrating plate 109 and the protective film 113 having low ink repellent properties. There is a concern that the ink may form a meniscus in the opening 601. When the meniscus is formed, ink discharge may be hindered. In order to prevent this drawback, for example, the pressure of the ink supplied to the ink supply port 402 is controlled such that the position of the meniscus of the ink becomes stable in the nozzle 101. Specifically, when the diameter of the nozzle 101 is Dn, the diameter of the opening 601 is Do, the surface tensile of the ink is σ, and the relative pressure of the ink supplied to the ink supply port 402 is P, the pressure P of the ink supplied to the ink supply port 402 is controlled so as to satisfy $-4\sigma/Dn<P<-4\sigma/Do$. Here, the relative pressure represents a pressure when atmospheric pressure is set to 0.

On the other hand, when the ink repellent film 116 covers the first inner peripheral surface 602 of the opening 601 as in the first embodiment, the ink is prevented from flowing to the first inner peripheral surface 602 of the opening 601. A part of the second surface 502 of the vibrating plate 109 which surrounds the nozzle 101 is not covered by the ink repellent film 116, but the part of the second surface 502 is a small region between the nozzle 101 and the second inner peripheral surface 605 of the ink repellent film 116. Therefore, even when the ink leaks out and spreads on the part of the second surface 502, the ink is attracted to the nozzle 101 by the pressure (negative pressure generated in the nozzle 101) of the ink which is supplied to the ink supply port 402.

Therefore, the position of the meniscus of the ink becomes stable and the ink is retained inside the nozzle 101. In this case, the relative pressure P of the ink supplied to the ink supply port 402 may be controlled so as to satisfy $-4\sigma/Dn<P<0$. That is, a control range of the relative pressure P of the ink becomes wider, as compared to a case in which the ink repellent film 116 does not cover the opening 601. Accordingly, when the ink in the ink jet head 21 is prevented from being discharged, the relative pressure P of the ink is easily controlled.

The diameter of the second inner peripheral surface 605 is larger than the diameter of the nozzle 101. Accordingly, for example, it is possible to prevent deterioration in discharge position accuracy of ink caused by blocking of apart of the nozzle 101 by the ink repellent film 116.

A part of the second surface 502 which surrounds the nozzle 101 is not covered by the protective film 113 and ink repellent film 116. Therefore, it is possible to prevent the opening 601 from negatively affecting the ink discharge from the nozzle 101 and to prevent deterioration in discharge position accuracy of ink.

Next, a second embodiment will be described with reference to FIG. 7. Regarding plural embodiments disclosed below, the same reference numerals are attached to components having the same functions as those of the ink jet printer 1 according to the first embodiment. Further, the descriptions of the components will be partially or completely omitted.

Figure 7:
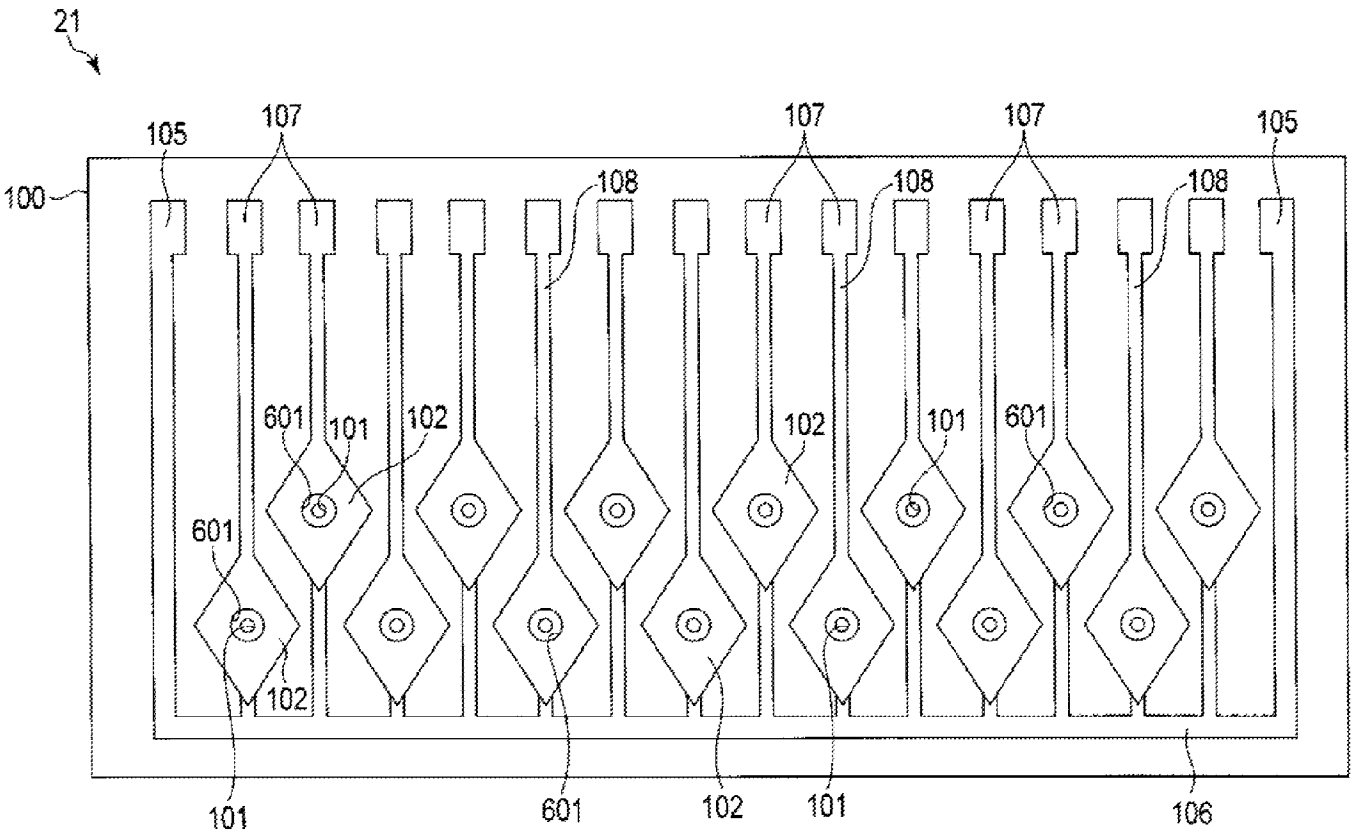
FIG. 7 is a plan view of an ink jet head according to a second embodiment.

FIG. 7 is a plan view of the ink jet head 21 according to the second embodiment. The actuator 102 in the second embodiment is different from the actuator 102 in the first embodiment in shape.

The actuator 102 in the second embodiment is formed in a diamond shape. The width of the actuator 102 is, for example, 170 μm, and the length is, for example, 340 μm. The nozzle 101 is disposed in the center of the actuator 102. The pressure chamber 201 is also formed in a diamond shape corresponding to the shape of actuator 102.

The actuators 102 in the second embodiment may be arranged at a higher density than the circular actuators 102 in the first embodiment. That is, the actuators 102 in the second embodiment are easily arranged in zigzag by forming the actuators 102 in a diamond shape.

Figure 8:
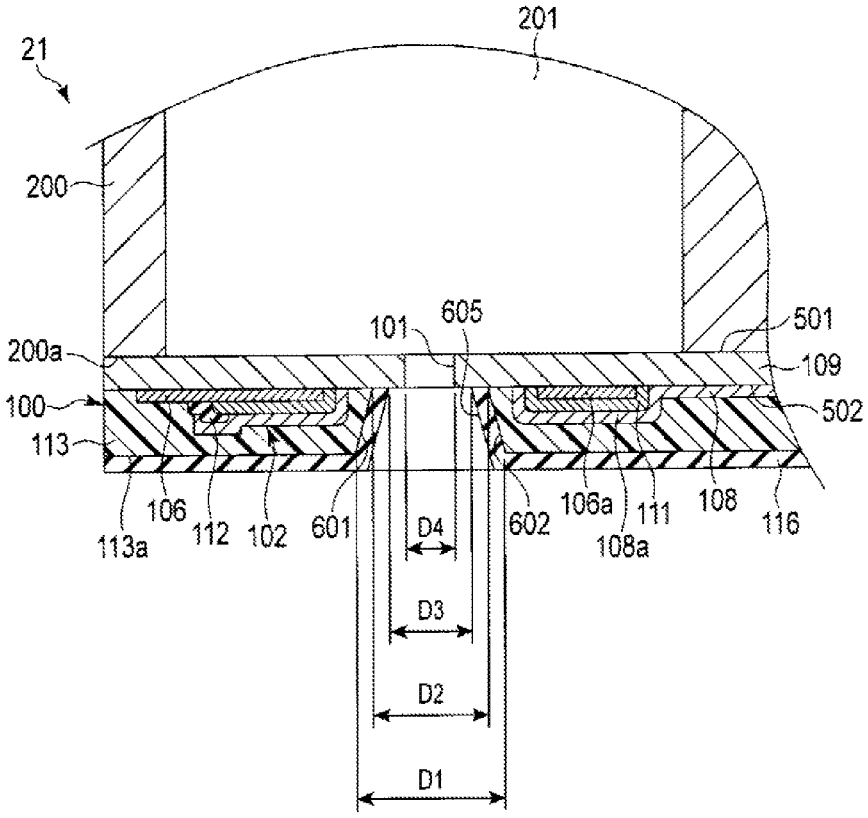
FIG. 8 is a cross-sectional view of a part of an ink jet head according to a third embodiment.

Next, a third embodiment will be described with reference to FIG. 8. FIG. 8 is a cross-sectional view of a part of the ink jet head 21 according to the third embodiment. As shown in FIG. 8, the shape of the opening 601 in the third embodiment is different from the shape of the opening in the first embodiment.

The diameter of the opening 601 is reduced in a direction from the surface 113*a* of the protective film 113 to the vibrating plate 109. In other words, the first inner peripheral surface 602 of the opening 601 is inclined with respect to the vibrating plate 109. As shown in FIG. 8, a diameter D1 of the first inner peripheral surface 602 on the surface 113*a* of the protective film 113 is larger than a diameter D2 of the first inner peripheral surface 602 which is in contact with the vibrating plate 109.

The second inner peripheral surface 605 on which the ink repellent film 116 is formed is also inclined substantially along the first inner peripheral surface 602. In such a third embodiment, a diameter D3 (26 μm) of the second inner peripheral surface 605 which is in contact with the vibrating plate 109 is formed to be larger than a diameter D4 (20 μm) of the nozzle 101.

In the third embodiment, the protective film 113 is formed of, for example, negative photosensitive polyimide. A region of the negative photosensitive polyimide subject to an exposing process remains after a development process.

When the opening 601 is formed on the protective film 113, a film of a solution containing a polyimide precursor is formed on the second surface 502 of the vibrating plate 109 by a spin coating method, and then pre-baking is performed. Next, exposure using a mask in which a circular pattern section (opening 601), the wiring electrode terminal section 107, and the common electrode terminal section 105 are blocked from light, and patterning are performed through a development process. Then, post-baking is performed to bake and form the protective film. An exposing apparatus is configured such that light in an exposing process proceeds only in a vertical direction as much as possible as a component with respect to the mask. However, a light component spreading in a plane direction remains without being completely removed. Therefore, since the light spreads in the negative photosensitive polyimide film in the plane direction, the area (diameter D2) of the blocked section which is in contact with the vibrating plate 109 may be smaller than the area (diameter D1) of the blocked section on the surface 113*a* (discharge surface) of the protective film 113.

As described above, the first inner peripheral surface 602 of the opening 601 is covered by the ink repellent film 116. Therefore, the shape of the blocked section of the exposure mask of the protective film 113 and the etching mask shape and the etching condition of the ink repellent film 116 are adjusted so that the diameter D2 of the first inner peripheral surface 602 which is in contact with the vibrating plate 109 is 30 μm, and the diameter D3 of the second inner peripheral surface 605 which is in contact with the vibrating plate 109 is 26 μm.

As in the third embodiment, the first inner peripheral surface 602 of the opening 601 is inclined with respect to the vibrating plate 109 by forming the protective film 113, for example, using negative photosensitive polyimide in some cases. Even in this case, it is possible to prevent deterioration in discharge position accuracy of ink as in the first embodiment.

Figure 9:
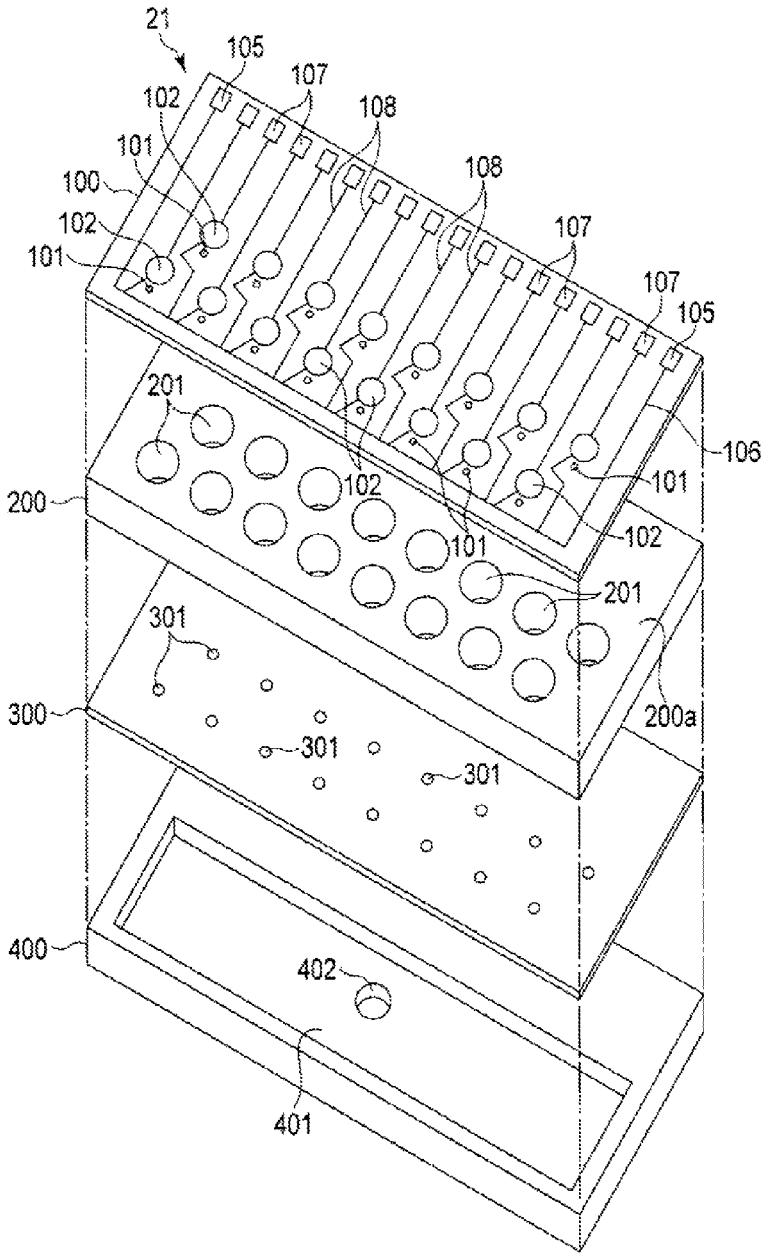
FIG. 9 is an exploded perspective view of an ink jet head according to a fourth embodiment.
Figure 10:
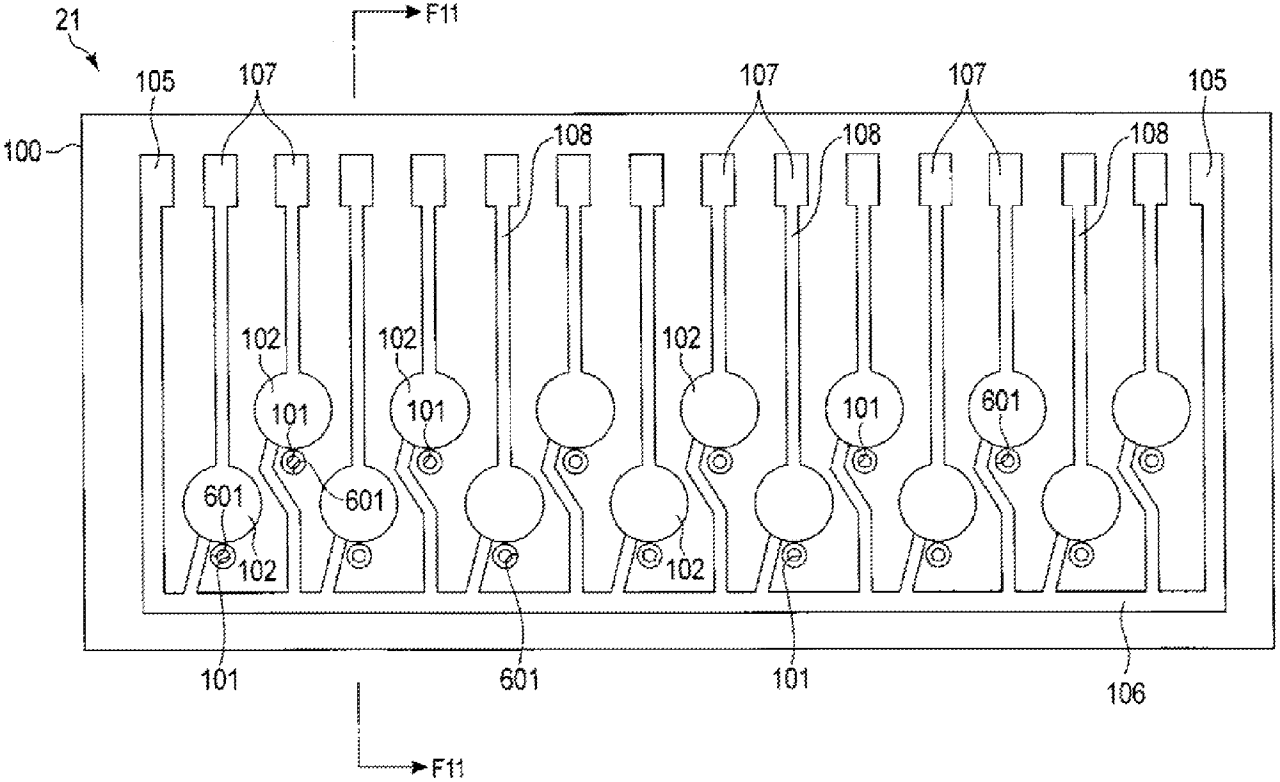
FIG. 10 is a plan view showing of ink jet head according to the fourth embodiment.
Figure 11:
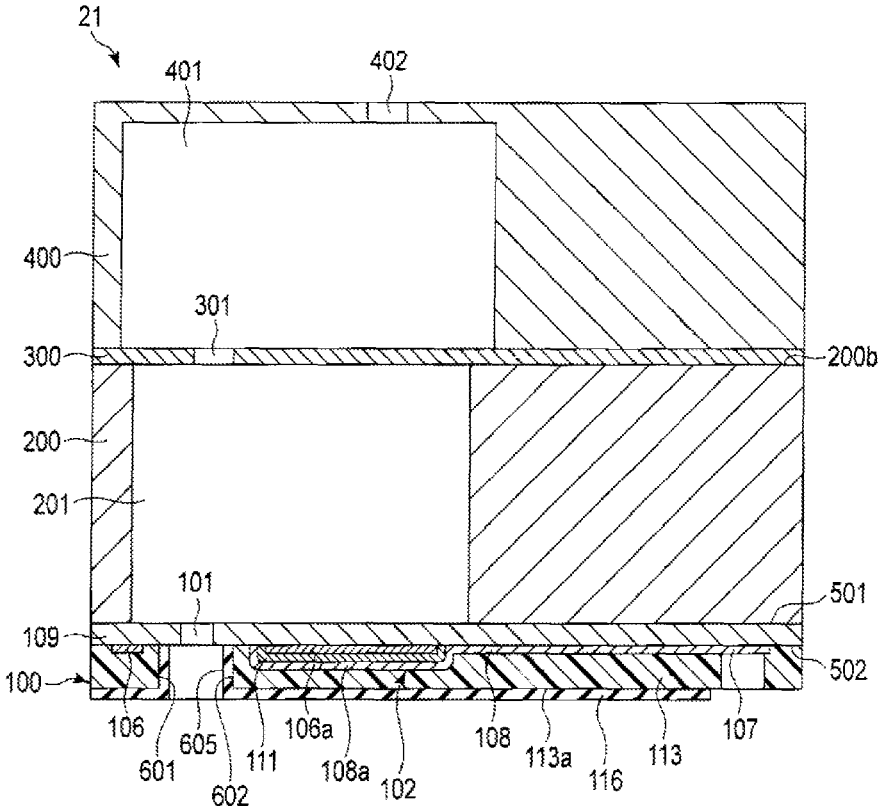
FIG. 11 is a cross-sectional view of the ink jet head according to the fourth embodiment.

Next, a fourth embodiment will be described with reference to FIGS. 9 to 11. FIG. 9 is an exploded perspective view of the ink jet head 21 according to the fourth embodiment. FIG. 10 is a plan view of the ink jet head 21 according to the fourth embodiment. FIG. 11 is a plan view of the ink jet head 21 taken along a line F11-F11 of FIG. 10. As shown in FIG. 9, the nozzle 101 in the fourth embodiment is different from the nozzle in the first embodiment and is arranged outside the actuator 102.

The center of the corresponding nozzle 101 is disposed at a position distant from the center of the circular cross-section of the pressure chamber 201. The pressure chamber 201 surrounds the corresponding actuator 102 and the nozzle 101. Therefore, the nozzle 101 communicates with the pressure chamber 201.

As shown in FIG. 11, the opening 601 is formed on the protective film 113. The opening 601 and the nozzle 101 are arranged on the same axis. Thus, the center of the corresponding opening 601 is disposed at a position distant from the center of the circular cross-section of the pressure chamber 201.

The actuator 102 is formed in a circular shape and disposed at a different position from the corresponding nozzle 101. The center of the actuator 102 is disposed at a position distant from the center of the circular cross-section of the pressure chamber 201. The actuator 102 and the pressure chamber 201 may be arranged on the same axis.

In the ink jet head 21 according to the fourth embodiment, the nozzle 101 is arranged at a different position from the actuator 102. Therefore, circular patterning for forming the nozzle 101 does not need to be performed at the center of the common electrode 106, the piezoelectric film 111, and the wiring electrode 108 in the actuator 102. Thus, it is possible to prevent poor accuracy in an ink discharge position caused by a patterning defect.

In at least one of the above-described ink jet heads, the vibrating plate includes the nozzle and the protective film includes the opening which exposes the nozzle and a part of the second surface of the vibrating plate surrounding the nozzle. Therefore, the shape of the nozzle may be determined by one process of forming the nozzle on the vibrating plate, and uniformity in the shape of the nozzle is improved. Accordingly, it is possible to prevent deterioration in discharge position accuracy of ink.

While certain embodiments have been described, these embodiments have been presented by way of example only, and are not intended to limit the scope of the inventions. Indeed, the novel embodiments described herein may be embodied in a variety of other forms. Furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the opening 601 is not limited to the circular hole and may be a hole, for example, having another shape such as an oval shape, a rectangular shape, or a diamond shape. In addition, the shape of the actuator 102 is not limited to the circular shape or diamond shape, and may be other shapes such as an oval shape or a rectangular shape. Further, the first inner peripheral surface 602 of the opening 601 may not be covered by the ink repellent film 116.

Further, the ink jet head 21 may not have the separate plate 300. In the ink jet head 21 not having the separate plate 300, ink may be discharged by adjusting the specifications of the ink jet head 21 and the diameter and depth of the pressure chamber 201.

Further, in the embodiments, the vibrating plate 109 is formed on the pressure chamber structure 200. However, instead of forming the vibrating plate 109 on the pressure chamber structure 200, apart of the pressure chamber structure 200 may be used as the vibrating plate. For example, the actuator 102 is formed on the first end surface 200*a* of the pressure chamber structure 200, and a hole that does not penetrate the pressure chamber structure 200 is formed at a position corresponding to the pressure chamber 201 from the second end surface 200*b*. A thin layer remains on the first end surface 200*a* side of the pressure chamber structure 200 and this section operates as the vibrating plate.

In addition, the ink jet head 21 may have the plural vibrating plates 109 which cover each pressure chamber 201. The vibrating plate 109 may be fixed to the first end surface 200*a* of the pressure chamber structure 200, for example, by an adhesive.

What is claimed is:

1. An ink jet head comprising:

a pressure chamber formed to hold ink;

a vibrating plate forming a wall of the pressure chamber and having a first opening through which the ink held in the pressure chamber is discharged;

a driving element that is provided on a surface of the vibrating plate and configured to cause a volume of the pressure chamber to be changed by deforming the vibrating plate upon application of voltage to the driving element; and a protective film covering the driving element and having a second opening aligned with the first opening and through which the ink held in the pressure chamber is discharged;

wherein the second opening is larger than the first opening and a surface portion of the vibrating plate is exposed by the second opening.

2. The ink jet head according to claim 1, wherein the first and second openings each have a circular shape, and a diameter of the first opening is smaller than a diameter of the second opening.

3. The ink jet head according to claim 1, wherein the second opening is tapered and a diameter of the first opening is smaller than a smallest diameter of the second opening.

4. The ink jet head according to claim 1, wherein the film includes an ink repellent layer that covers a surface of the protective film that is exposed to the second opening.

5. The ink jet head according to claim 1, wherein the driving element has an opening that is aligned with the first and second openings.

6. An ink jet printing apparatus, comprising:

an ink jet head comprising a pressure chamber formed to hold ink, a vibrating plate forming a wall of the pressure chamber and having a first opening through which the ink held in the pressure chamber is discharged, a driving element that is provided on a surface of the vibrating plate and configured to cause a volume of the pressure chamber to be changed by deforming the vibrating plate upon application of voltage to the driving element, and a protective film covering the driving element and having a second opening aligned with the first opening and through which the ink held in the pressure chamber is discharged;

an ink tank configured to store the ink and from which the ink is supplied to the pressure chamber; and a controller configured to apply a voltage to the driving element;

wherein the second opening is larger than the first opening and a surface portion of the vibrating plate is exposed by the second opening.

7. The ink jet printing apparatus according to claim 6, wherein the first and second openings each have a circular shape, and a diameter of the first opening is smaller than a diameter of the second opening.

8. The ink jet printing apparatus according to claim 6, wherein the second opening is tapered, and a diameter of the first opening is smaller than a smallest diameter of the second opening.

9. The ink jet printing apparatus according to claim 6, wherein the film includes an ink repellent layer that covers a surface of the protective film that is exposed to the second opening.

10. The ink jet printing apparatus according to claim 6, wherein the driving element has an opening that is aligned with the first and second openings.

11. A method for manufacturing an ink jet head, comprising:

forming a vibrating plate on one side of a pressure chamber configured to hold ink;

forming a driving element configured to deform the vibrating plate upon application of voltage to the driving element;

forming a first opening through the vibrating unit such that the ink held in the pressure chamber is to be discharged through the first opening;

forming a protective film so as to cover the driving element; and forming a second opening through the protective film, the second opening being aligned with the first opening such that the ink held in the pressure chamber is to be discharged through the first and second openings;

wherein the second opening is larger than the first opening and a surface portion of the vibrating plate is exposed by the second opening.

12. The method according to claim 11, wherein the first and second openings each have a circular shape, and a diameter of the first opening is smaller than a diameter of the second opening.

13. The method according to claim 11, wherein the second opening is tapered and a diameter of the first opening is smaller than a smallest diameter of the second opening.

14. The method according to claim 11, wherein the film includes an ink repellent layer that covers a surface of the film that is exposed to the second opening.

15. The method according to claim 11, wherein the driving element has an opening that is aligned with the first and second openings.

* * * * *